US006189507B1

(12) United States Patent
Tsuchiya et al.

(10) Patent No.: US 6,189,507 B1
(45) Date of Patent: Feb. 20, 2001

(54) THROTTLE VALVE CONTROL DEVICE

(75) Inventors: Hideki Tsuchiya, Kariya; Toru Fujikawa, Obu, both of (JP)

(73) Assignee: Aisin Seiki Kabushiki Kaisha, Kariya (JP)

( * ) Notice: Under 35 U.S.C. 154(b), the term of this patent shall be extended for 0 days.

(21) Appl. No.: 09/316,124

(22) Filed: May 20, 1999

(30) Foreign Application Priority Data

May 20, 1998 (JP) ..... 10-137892

(51) Int. Cl.[7] ..... F02D 41/00
(52) U.S. Cl. ..... 123/399; 123/396
(58) Field of Search ..... 123/399, 396; 251/305

(56) References Cited

U.S. PATENT DOCUMENTS 5,092,296 * 3/1992 Gunter et al. ..... 123/399
5,172,667 * 12/1992 Spiegel ..... 123/396
5,178,112 * 1/1993 Terazawa et al. ..... 123/400
5,295,409 * 3/1994 Byram et al. ..... 123/399
5,664,542 * 9/1997 Kanazawa et al. ..... 123/399

FOREIGN PATENT DOCUMENTS 7-97950 4/1995 (JP) .

* cited by examiner

*Primary Examiner*—Erick Solis
(74) *Attorney, Agent, or Firm*—Burns, Doane, Swecker & Mathis, LLP

(57) ABSTRACT

A throttle valve control device for controlling the amount of inlet air fed to an internal combustion engine has a throttle valve disposed in an air intake passage, a throttle shaft integrally connected with the throttle valve so as to rotate with the throttle valve in a body, a driving source for generating driving torque, and a driving torque transmitting mechanism disposed between the driving source and the throttle shaft for transmitting the driving torque to the throttle shaft. The driving torque transmitting mechanism includes a torque limiting mechanism for limiting the transmitted driving torque to a predetermined level.

20 Claims, 6 Drawing Sheets

THROTTLE VALVE CONTROL DEVICE

This application is based on and claims priority under 35 U.S.C. § 119 with respect to Japanese Application No. 10(1998)-137892 filed on May 20, 1998, the entire content of which is incorporated herein by reference.

FIELD OF THE INVENTION

The present invention generally relates to a throttle valve. More particularly, the present invention pertains to a throttle valve control device for controlling the amount of inlet air fed to an internal combustion engine.

BACKGROUND OF THE INVENTION

A known throttle valve control device is disclosed, for example, in Japanese Laid-Open Publication No. Hei 07(1995)-97950. The throttle valve control device includes a throttle valve, a gear mechanism, a DC motor, an electronic control unit (ECU), a throttle valve position sensor and an accelerator pedal sensor. The throttle valve position sensor detects the actual throttle valve position and outputs a throttle valve position signal to the ECU. The accelerator pedal sensor detects the actual accelerator pedal position and outputs an accelerator pedal position signal to the ECU. The ECU determines a target throttle valve position in response to the actual accelerator pedal position and other parameters representing engine driving conditions, for example, the amount of fuel injection to the engine and the temperature of the engine. The gear mechanism is disposed between the DC motor and the throttle valve to transmit the rotating torque from the DC motor to the throttle valve. The DC motor is turned on electrically by the ECU to drive the throttle valve via the gear mechanism. That is, the throttle valve is opened and closed by the DC motor which is controlled by the ECU. The ECU performs a servo-control based on Proportional Integral Derivative control (PID control) such that the actual throttle valve position corresponds to the target throttle valve position.

Generally speaking, for purposes of rotating the throttle valve within a predetermined range, the throttle valve control device has two stoppers. One stopper is a full opening stopper which is able to contact a part of the throttle valve when the throttle valve is positioned at the maximum opening position in the predetermined range. The other stopper is a closing stopper which is able to contact another part of the throttle valve when the throttle valve is positioned at the complete closing position or minimum opening position in the predetermined range. Therefore, if the throttle valve control device is in an abnormal state, for example when the throttle valve receives an excessive rotational torque, the position of the throttle valve is maintained in the predetermined range.

However, when the throttle valve control device is in the abnormal state by virtue of changing conditions, for example a change in environmental temperature or a change in voltage of the power source, the stoppers receive excessive torque. Accordingly, the DC motor and the parts of the gear mechanism are susceptible to becoming broken.

In an attempt to address this problem, it is of course possible to increase the strength of the parts. However, this increases the weight and the moment of inertia of the parts, thus decreasing the operating response.

A need thus exists for a throttle value control device that is not excessively heavy and does not have an excessively large moment of inertia, but which nevertheless is not susceptible to damage and breakage of the DC motor and gear parts.

SUMMARY OF THE INVENTION

According to one aspect of the present invention, a throttle valve control device for controlling the amount of inlet air fed to an internal combustion engine has a throttle valve disposed in an air intake passage, a throttle shaft integrally connected with the throttle valve so as to rotate with the throttle valve in a body, a driving source for generating driving torque, and a driving torque transmitting mechanism disposed between the driving source and the throttle shaft for transmitting the driving torque to the throttle shaft. The driving torque transmitting mechanism includes a torque limiting mechanism for limiting the transmitted driving torque to a predetermined level.

According to another aspect of the present invention, a throttle valve control device for controlling the amount of inlet air fed to an internal combustion engine includes a throttle valve disposed in an air intake passage, a throttle shaft integrally connected with the throttle valve so as to rotate with the throttle valve in a body, a driving source for generating driving torque, and a driving torque transmitting mechanism disposed between the driving source and the throttle shaft for transmitting the driving torque to the throttle shaft. The driving torque transmitting mechanism includes first and second gears urged apart from one another by an urging member.

BRIEF DESCRIPTION OF THE DRAWING FIGURES

The foregoing and additional features of the present invention will become more apparent from the following detailed description considered with reference to the accompanying drawing figures in which like elements are designated by like reference numerals and wherein.

DETAILED DESCRIPTION OF THE PREFERRED EMBODIMENTS

Figure 1:
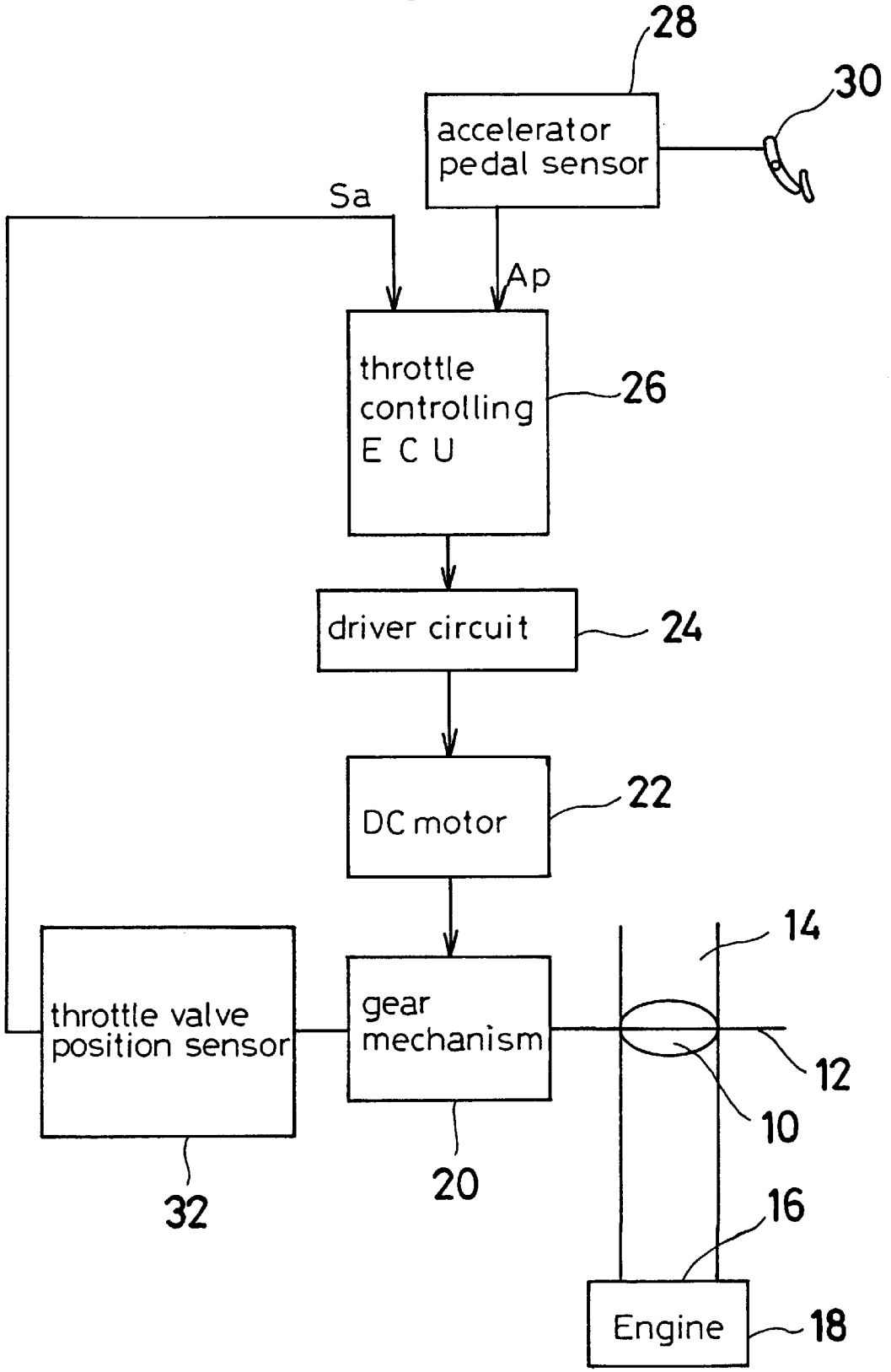
FIG. 1 is a simplified schematic illustration of a throttle valve control device in accordance with the prevent invention.
Figure 2:
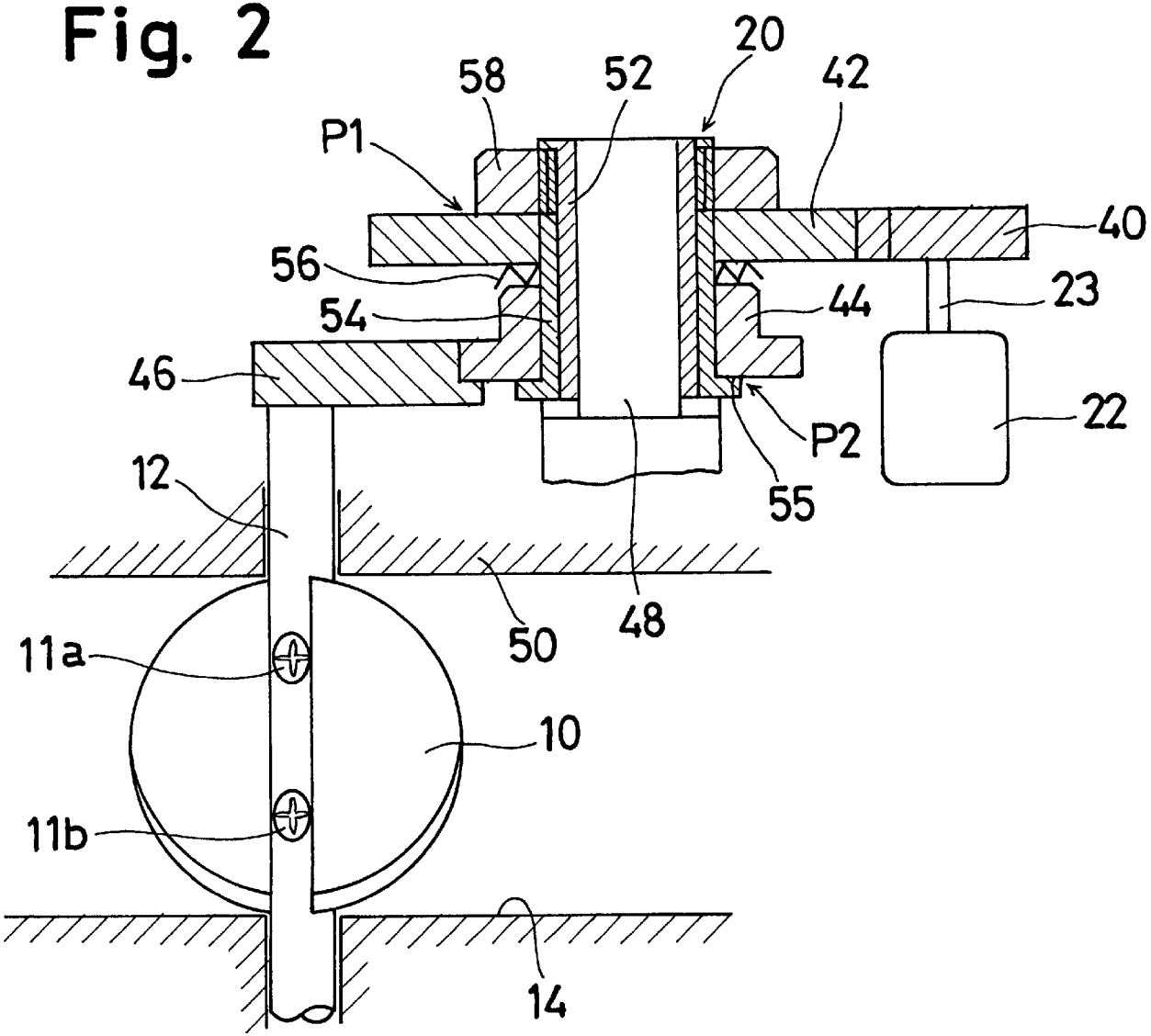
FIG. 2 is a cross-sectional view of a first embodiment of the gear mechanism forming a part of the throttle valve control device of the prevent invention.

Referring initially to FIG. 1, the throttle valve control device of the prevent invention includes a throttle valve 10 and other components for driving the throttle valve. The throttle valve 10 is integrally fixed to a throttle shaft 12 by a known mechanism such as by a pair of bolts 11*a*, 11*b* as shown in FIG. 2. The throttle valve 10 is rotatably supported in an intake passage 14 which communicates with an intake port 16 of an internal combustion engine 18. A gear mechanism 20 is attached to one end of the throttle shaft 12 and a DC motor 22 causes the throttle shaft 12 to rotate via the gear mechanism 20 so that the amount of inlet air fed to the internal combustion engine 18 is controlled. The DC motor 22 is driven by a driver circuit 24 in response to the duty ratio signal which is calculated by a throttle controlling electronic control unit (ECU) 26.

The throttle controlling ECU 26 receives an accelerator pedal position signal Ap from an accelerator pedal sensor 28 which detects the position of an accelerator pedal 30. The throttle controlling ECU 26 also receives other signals, for example signals indicating the amount of fuel injection to the internal combustion engine 18, the temperature of the internal combustion engine 18 and the like. The throttle controlling ECU 26 receives these signals from an engine controlling ECU so that the throttle controlling ECU 26 is able to calculate a target position of the throttle valve 10. A throttle valve position sensor 32 is disposed at or operatively associated with the gear mechanism 20 to detect the position of the throttle valve 10 and output a throttle valve position signal 5*a*. The throttle controlling ECU 26 receives the throttle valve position signal 5*a* from the throttle valve position sensor 32. The throttle controlling ECU 26 calculates the difference between the throttle valve position signal 5*a* and the target position of the throttle valve 10. To decrease the calculated difference, the throttle controlling ECU 26 carries out a PID control operation and calculates the duty ratio signal for supplying the driver circuit 24.

Figure 3:
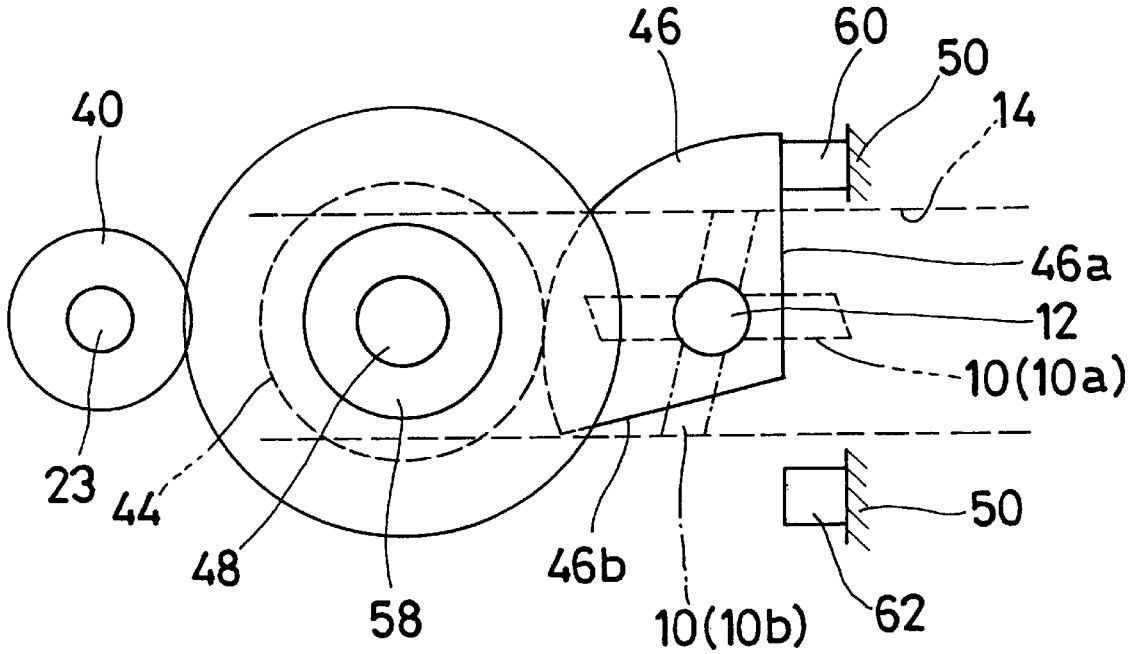
FIG. 3 is a side view of the gear mechanism shown in FIG. 2.

As shown in FIGS. 2 and 3, the gear mechanism 20 includes a pinion gear 40, a first gear 42, a second gear 44 and a final gear 46. An intermediate shaft 48 is supported in a housing 50. A bearing 52 is rotatably fitted around the intermediate shaft 48 and a hub 54 is rotatably fitted around the bearing 52.

As shown in FIG. 2, a flange portion 55 is integrally formed with the hub 54 at the bottom end of the hub 54. The second gear 44, a plate spring 56 and the first gear 42 are successively positioned in that order around the outer circumference of the hub 54 in a rotatable manner, and a nut or intermediate member 58 is fastened around the hub 54 adjacent the axial end of the hub.

The plate spring 56 possesses a plurality of annular creases as shown in FIG. 2, and contacts the first gear 42 and the second gear 44 to push both the first gear 42 and the second gear 44 in the axial direction of the intermediate shaft 48. That is, the spring 56 urges the first gear 42 and the second gear axially away from one another. As a result, the first gear 42 contacts the nut 58 to generate a first frictional force at a first contacting portion P1 between the first gear 42 and the nut 58. Further, the second gear 44 contacts the flange portion 55 of the hub 54 to generate a second frictional force at a second contacting portion P2 between the second gear 44 and the flange portion 55. It is to be noted that the area of the first contacting particular P1 is greater than the area of the second contacting portion P2.

The pinion gear 40 is fixed to an output shaft 23 of the DC motor 22 and engages the first gear 42. The final gear 46 is fixed to the throttle shaft 12 which integrally rotates with the throttle valve 10. The final gear 46 is a sector shaped gear as shown in FIG. 3 and engages the second gear 44. The driving torque of the DC motor 22 is transmitted to the first gear 42 via the output shaft 23, the pinion gear 40 and the engagement between the pinion gear 40 and the first gear 42. The driving torque which is transmitted to the first gear 42 is transmitted to the nut 58 which integrally rotates with the flange portion 55 of the hub 54 via the first frictional force between the first gear 42 and the nut 58 in the first contact portion P1. The driving torque which is transmitted to the flange portion 55 of the hub 54 is further transmitted to the second gear 44 via the second frictional force between the second gear 44 and the flange portion 55 in the second contacting portion P2. Finally, the driving torque which is transmitted to the second gear 44 is transmitted to the final gear 46 via the engagement between the second gear 44 and the final gear 46. Accordingly, the DC motor 22 rotates the throttle shaft 12 to drive or operationally move the throttle valve 10.

As shown in FIG. 3, because of the sector shaped nature of the final gear 46, the final gear 46 has two end surfaces 46*a*, 46*b*. A full opening stopper 60 and a full closing stopper 62 are disposed in the housing 50. One of the end surfaces 46*a* contacts the full opening stopper 60 when the position of the throttle valve 10(10*a*) is the maximum opening position that is shown in broken line in FIG. 3. The other end surface 46*b* contacts the complete or full closing stopper 62 when the position of the throttle valve 10(10*b*) is the completely or fully closed position that is shown in dot-dash line in FIG. 3. As a result, the final gear 46 is able to rotate within a predetermined range defined at one end by the engagement between the end surface 46*a* and the full opening stopper 60 and at the other end by the engagement between the end surface 46*b* and the fully closing stopper 62. The throttle valve 10 is thus rotated within this predetermined range.

In accordance with the present invention, if an excessive torque is applied to the first gear 42, for example when the voltage of the DC motor is increased, the first gear 42 and the second gear 44 can rotate relative to one another against the frictional forces of the plate spring 56. Considered in a bit more detail, because the area of the second contacting portion P2 is smaller than the area of the first contacting portion P1 as shown in FIG. 2, the second gear 44 tends to rotate around the hub 54 more than the first gear 42. Accordingly, if excessive torque is applied to the first gear 42, the first gear 42 is integrally rotated with the nut 58 and the hub 54, but the second gear 44 is not rotated around the hub 54. As a result, the second frictional force at the second contacting portion P2 performs as a torque limiting mechanism or carries out a torque limiting function in that the transmitting torque from the first gear 42 to the second gear 44 is always less than a predetermined level. Here, because the first and the second frictional forces produced by the plate spring 56 are dependent upon the fastening torque or degree of fastening of the nut 58, it is rather easy to change the predetermined level of the transmitting torque by controlling or changing the fastening torque or degree of fastening of the nut 58.

Figure 4:
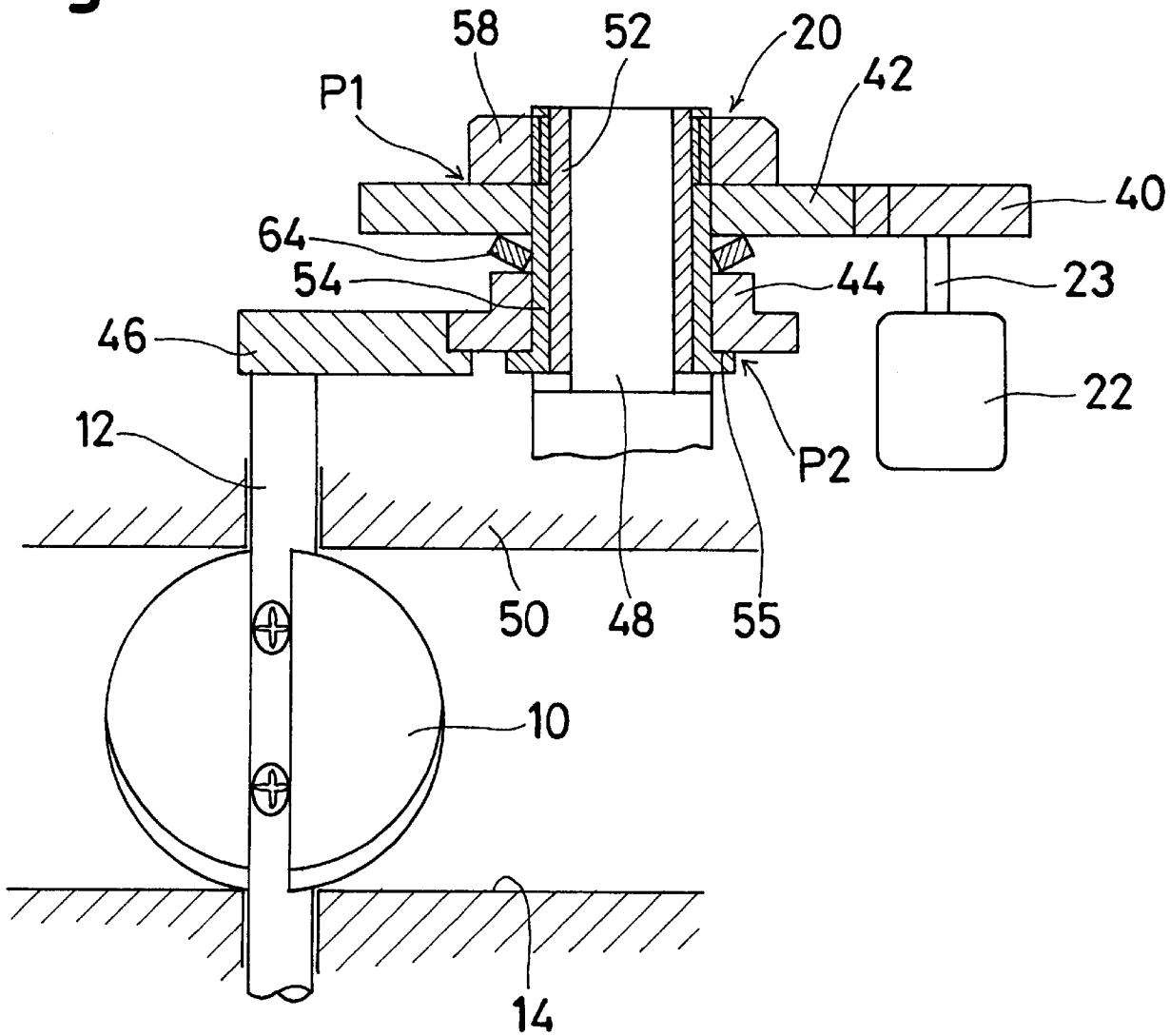
FIG. 4 is a cross-sectional view similar to FIG. 2, but showing a second embodiment of the gear mechanism used in the throttle valve control device of the prevent invention.

FIG. 4 illustrates an alternative version of the gear mechanism involving the use of a different type of spring, namely a modified plate spring 64. In the embodiment shown in FIG. 4, the parts of the gear mechanism corresponding to those shown in the embodiment of FIG. 2 are identified with the same reference numerals used in FIG. 2. In this alternative version shown in FIG. 4, the plate spring 66, which is arranged between the first gear 42 and the second gear 44, possesses a conical shape.

Figure 5:
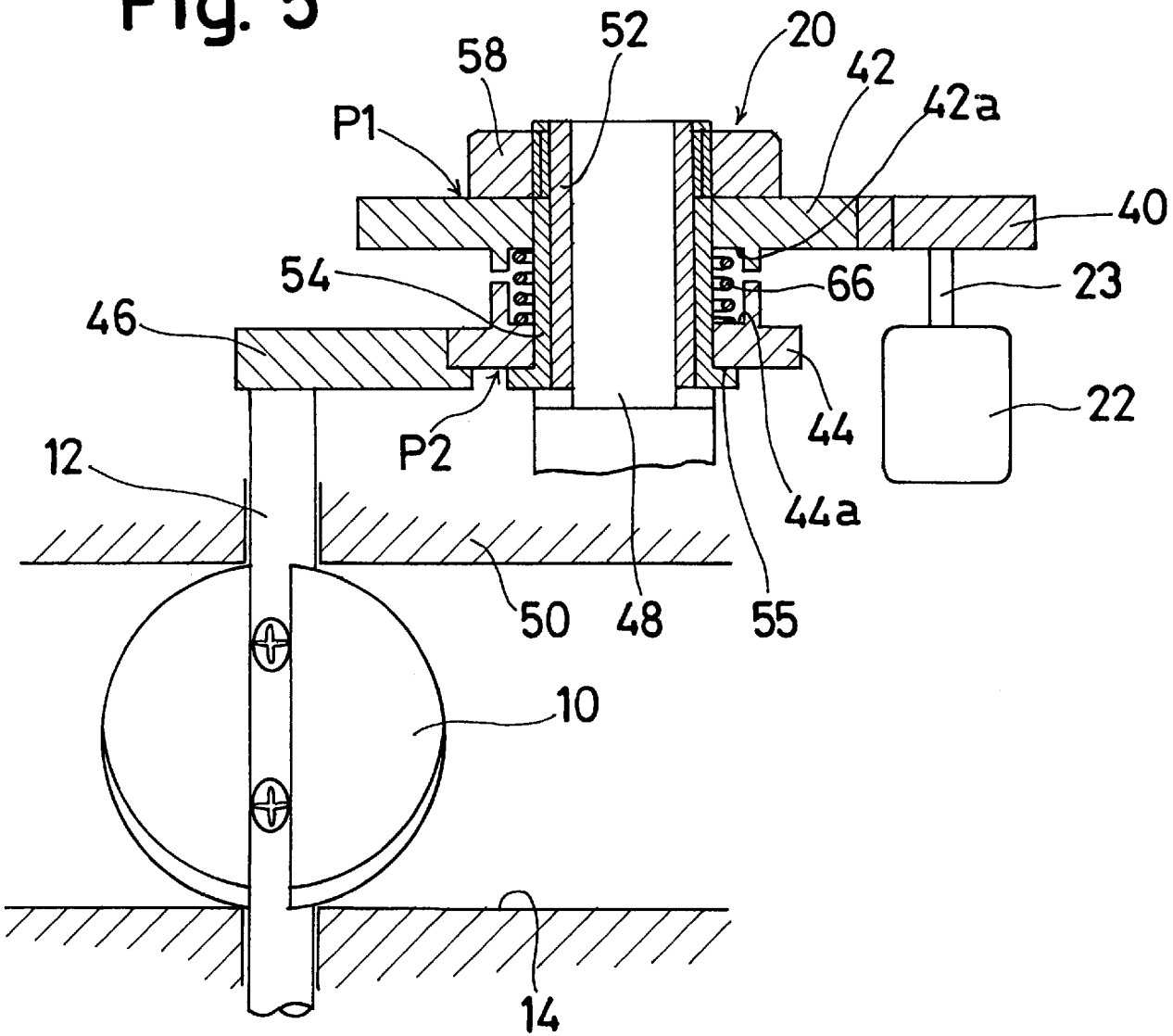
FIG. 5 is a cross-sectional view similar to FIG. 2, but showing a third embodiment of the gear mechanism used in the throttle valve control device of the prevent invention.

FIG. 5 illustrates another alternative version of the gear mechanism involving the use of a coil spring 66. In the embodiment shown in FIG. 5, the parts of the gear mechanism corresponding to those shown in the embodiment of FIG. 2 are identified with the same reference numerals used in FIG. 2. In this version shown in FIG. 5, the coil spring 66 is arranged between the first gear 42 and the second gear 44. For purposes of arranging and positioning the coil spring 66, both the first gear 42 and the second gear 44 are provided with axially extending housings defining hollow portions 42*a*, 44*a*. The hollow portion 42*a* of the first gear 42 faces the hollow portion 44*a* of the second gear 44 to thereby support the end portions of the coil spring 66.

Figure 6:
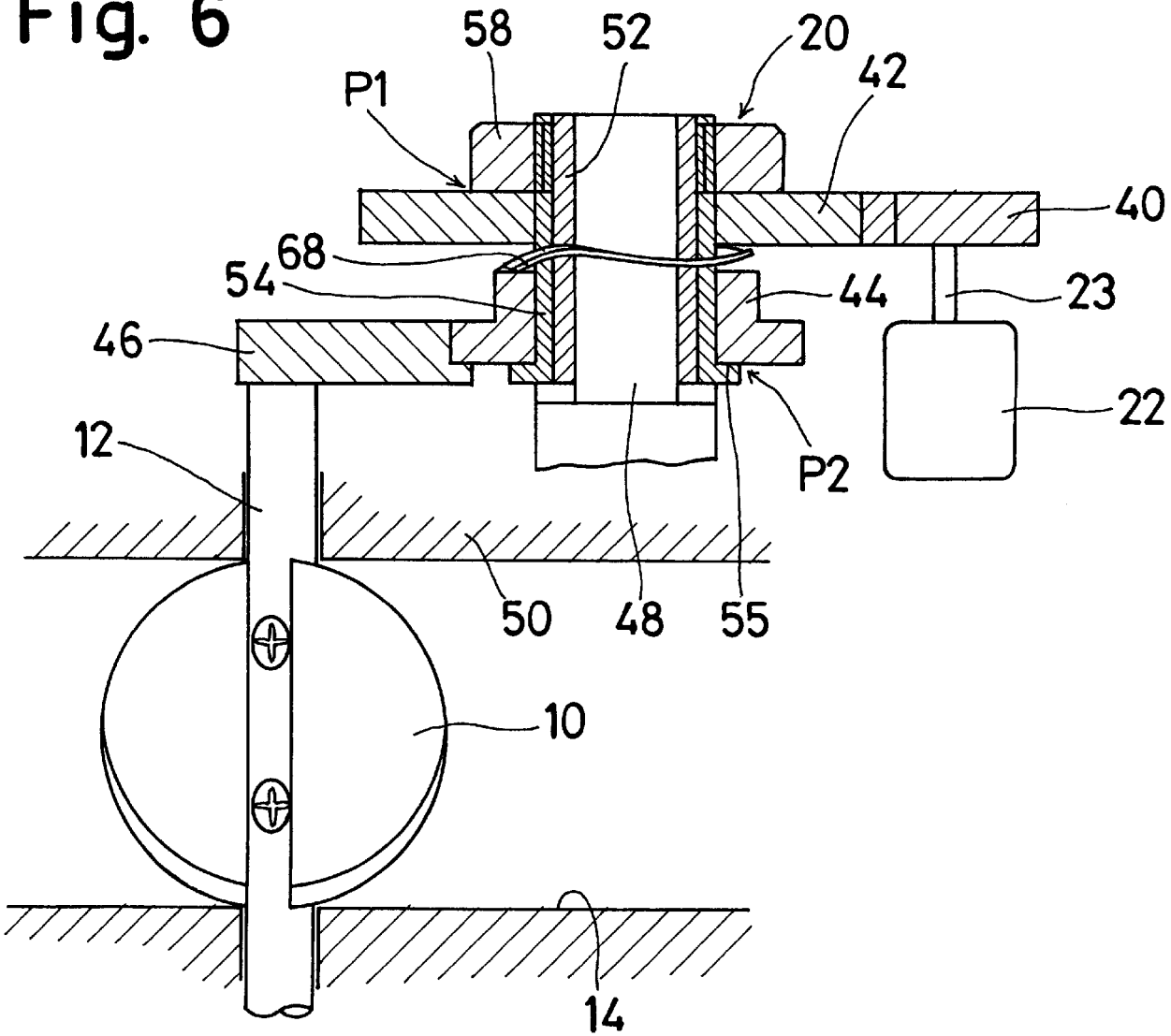
FIG. 6 is a cross-sectional view similar to FIG. 2, but showing a fourth embodiment of the gear mechanism used in the throttle valve control device of the prevent invention.

FIG. 6 illustrates a still further alternative version of the gear mechanism involving the use of a wave washer 68. FIG. 6 is a cross-sectional view of the gear mechanism, with the wave washer 68 being shown in side view. In the embodiment shown in FIG. 6, the parts of the gear mechanism corresponding to those shown in FIG. 2 are identified with the same reference numerals. In this version shown in FIG. 6, the wave washer 68, which is arranged between the first gear 42 and the second gear 44, has plurality of waves along its circumferential extent.

By virtue of the present invention as embodied by way of example in the various embodiments described above, the throttle valve control device is not readily susceptible to damage and breakage of the motor and gear parts. However, the throttle value control device is not excessively heavy and does not possess an excessively large moment of inertia.

The principles, preferred embodiments and modes of operation of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A throttle valve control device for controlling the amount of inlet air fed to an internal combustion engine comprising:

a throttle valve disposed in an air intake passage;

a throttle shaft connected with the throttle valve to rotate together with the throttle valve;

a driving source for generating driving torque; and a driving torque transmitting mechanism disposed between the driving source and the throttle shaft for transmitting the driving torque to the throttle shaft, the driving torque transmitting mechanism including a torque limiting mechanism for limiting the driving torque transmitted to the throttle valve to a predetermined level.

2. A throttle valve control device according to claim 1, wherein the driving torque transmitting mechanism includes a gear mechanism, the gear mechanism including:

a pinion gear fixed to an output shaft of the driving source;

a final gear fixed to the throttle shaft;

a first gear engaged with the pinion gear; and a second gear engaged with the final gear, the second gear transmitting driving torque from the first gear via the torque limiting mechanism when the transmitted driving torque of the first gear is more than the predetermined level.

3. A throttle valve control device according to claim 2, wherein the torque limiting mechanism includes an urging member for applying an urging force to one of the first gear and the second gear.

4. A throttle valve control device according to claim 3, wherein the first and second gears are mounted on a hub, said urging member urging the second gear into frictional engagement with a part of said hub.

5. A throttle valve control device according to claim 4, wherein the urging member is a spring which is sandwiched between the first gear and the second gear.

6. A throttle valve control device according to claim 5, wherein the spring is a plate spring.

7. A throttle valve control device according to claim 5, wherein the spring is a wave washer.

8. A throttle valve control device according to claim 5, wherein the spring is a coil spring.

9. A throttle valve control device according to claim 3, wherein the first and second gears are mounted on a hub, the hub including an intermediate member, said urging member urging the first gear into frictional engagement with the intermediate member of said hub.

10. A throttle valve control device according to claim 9, wherein the intermediate member is a nut fastened to the hub.

11. A throttle valve control device for controlling the amount of inlet air fed to an internal combustion engine comprising:

a throttle valve disposed in an air intake passage;

a throttle shaft connected with the throttle valve to rotate together with the throttle valve;

a driving source for generating driving torque during operation; and a driving torque transmitting mechanism disposed between the driving source and the throttle shaft for transmitting the driving torque to the throttle shaft, the driving torque transmitting mechanism including a torque limiting mechanism for limiting the driving torque transmitted to the throttle valve to a predetermined level whenever the driving source is operating.

12. A throttle valve control device according to claim 11, wherein the driving torque transmitting mechanism includes first and second gears urged apart from one another by an urging member the driving torque transmitting mechanism also including a pinion gear engaging the first gear, and a final gear fixed to the throttle shaft.

13. A throttle valve control device according to claim 11, wherein the driving torque transmitting mechanism includes first and second gears urged apart from one another by an urging member, the first and second gears being mounted on a hub, said urging member urging the second gear into frictional engagement with a part of said hub.

14. A throttle valve control device according to claim 13, wherein the hub includes an intermediate member, said urging member urging the first gear into frictional engagement with the intermediate member of said hub.

15. A throttle valve control device according to claim 14, wherein the intermediate member is a nut fastened to the hub.

16. A throttle valve control device according to claim 13, wherein the urging member is a spring which is sandwiched between the first gear and the second gear.

17. A throttle valve control device according to claim 16, wherein the spring is a plate spring.

18. A throttle valve control device according to claim 16, wherein the spring is a wave washer.

19. A throttle valve control device according to claim 16, wherein the spring is a coil spring.

20. A throttle valve control device for controlling the amount of inlet air fed to an internal combustion engine comprising:

a throttle valve disposed in an air intake passage;

a throttle shaft connected with the throttle valve to rotate together with the throttle valve;

a driving source for generating driving torque; and a driving torque transmitting mechanism disposed between the driving source and the throttle shaft for transmitting the driving torque to the throttle shaft, the driving torque transmitting mechanism including a torque limiting mechanism for limiting the driving torque transmitted to the throttle valve to a predetermined level greater than zero.

* * * * *